United States Patent [19]

Warwicker

[11] Patent Number: 4,858,326

[45] Date of Patent: Aug. 22, 1989

[54] GEOMETRIC INSTRUMENT AND METHOD OF MAKING SAME

[75] Inventor: Clive W. Warwicker, Bookely, Nr. Kidderminster, England

[73] Assignee: Helix Group PLC., Stourbridge, England

[21] Appl. No.: 51,670

[22] Filed: May 18, 1987

[30] Foreign Application Priority Data

May 23, 1986 [GB] United Kingdom ..... 8612656

[51] Int. Cl.[4] ..... B43L 9/02

[52] U.S. Cl. ..... 33/27.02; 33/558.5

[58] Field of Search ..... 33/27.02, 157

[56] References Cited

U.S. PATENT DOCUMENTS 902,257 10/1908 Schoenner ..... 33/157

4,146,965 4/1979 Payton ..... 33/27.02

FOREIGN PATENT DOCUMENTS 169312 11/1951 Austria ..... 33/157

*Primary Examiner*—Harry N. Haroian

*Attorney, Agent, or Firm*—Bauer & Schaffer

[57] ABSTRACT

A pair of compasses has legs articulated by a pivot pin. Each leg is of moulded plastics with a strengthening metal insert provided in each leg. Projecting circular parts of the inserts are overlapped and articulated together by the pin within a bow top.

10 Claims, 2 Drawing Sheets

GEOMETRIC INSTRUMENT AND METHOD OF MAKING SAME

This invention relates to a geometric instrument, for example a pair of compasses or a divider, having two legs which are articulated to one another, and also to a method of making such an instrument.

Although such geometric instruments have been in existence for many years from time to time improvements are made in their basic construction in order to produce an instrument which is more cost effective and yet which still has the required degree of accuracy. Indeed, in order to reduce costs it has been proposed to produce the legs of the instrument in plastics, by an injection moulding technique. Nevertheless, in order to maintain a sufficient degree of strength and rigidity in the legs the articulation of the legs to one another has necessarily had to be modified away from the usual articulation employing a single pivot pin and thus to an articulation which might not be preferred or which is not as cost effective as other forms of articulation. Additionally, in some instances a greater degree of rigidity in the legs may be preferred than is allowed for in designs employing plastics legs.

It is an object of the present invention to provide a geometric instrument and method of making same which is improved in at least some respect and which may at least alleviate at least one of the aforementioned disadvantages.

According to the present invention there is provided a geometric instrument comprising two legs articulated to one another and in which at least one of the legs has a strengthening insert.

By the present invention an instrument may be provided in which the legs may be articulated to one another in a generally standard fashion employing a single pivot pin.

Further according to the present invention there is provided a method of making a geometric instrument having two legs articulated to one another, said method comprising:

(a) forming at least one of said two legs with a strengthening insert of a material, for example metal, which has a greater rigidity and strength than the remainder of said leg;

(b) articulating said legs to one another on a bow top of the instrument.

Usually, said at least one leg will be moulded around the insert, for example in a book mould. The insert may be, for example, of rigid die cast metal and the remainder of said leg may be of plastics or any like mouldable material.

Preferably, part of the insert projects from one end of said leg and is used in the articulation of the two legs to one another.

Conveniently, in order to tend to maximise the cost effectiveness of the insert moulding technique each of the two legs will have a strengthening insert.

In order to give the required degree of strength and rigidity it is envisaged that the insert will usually extend at least about half the length of the associated leg, and preferably, be of about one third to one half the cross sectional area of the leg and be, preferably, of uniform thickness along the leg.

The or each insert may be generally of rectangular cross-section and, preferably, extend centrally of the associated leg.

In one embodiment of the present invention each of said legs is provided with an insert having a part projecting from one end (the upper end) of its associated leg and each said projecting part is used in the articulation of the legs. The projecting parts may be generally circular and may be overlapped and articulated to one another by means of a pivot pin passing through aligned apertures in said projecting parts and through spaced side walls of a bow top which receives the projecting parts. The articulation of the legs may be of a standard form known per se which may be self centering. Where the instrument is a pair of compasses having one leg which terminates in a hole and which is substantially shorter than the other of said legs the insert preferably extends almost the entire length of the leg. Conveniently, the inserts are substantially identical to one another.

The legs themselves may be suitably externally configured to facilitate extraction from the mould where the legs are formed by a moulding process as aforesaid.

In practice the Applicant has made several very important further steps in the production of the geometric instrument where said at least one leg is set around the insert. Certain problems have occurred in the manufacturing technique so that not all instruments have been found to be of reliable strength, resulting in breakage of said leg. In order to counteract such an eventuality the Applicant has taken two major steps. Firstly, centralising means (preferably in the form of pips on the insert) may be provided to stabilise the insert and annul movement thereof whilst the leg material sets around the insert. This ensures that the leg material is distributed evenly around the insert obviating weaker areas caused by de-centralisation of the insert in the leg. Secondly, one end of the insert embedded in said at least one leg may be tapered to give more strength to the leg and substantially prevent accidental breakage.

An embodiment of a pair of compasses and method of making same in accordance with the present invention will now be described, by way of example only, with reference to the accompanying drawings in which.

Figure 1:
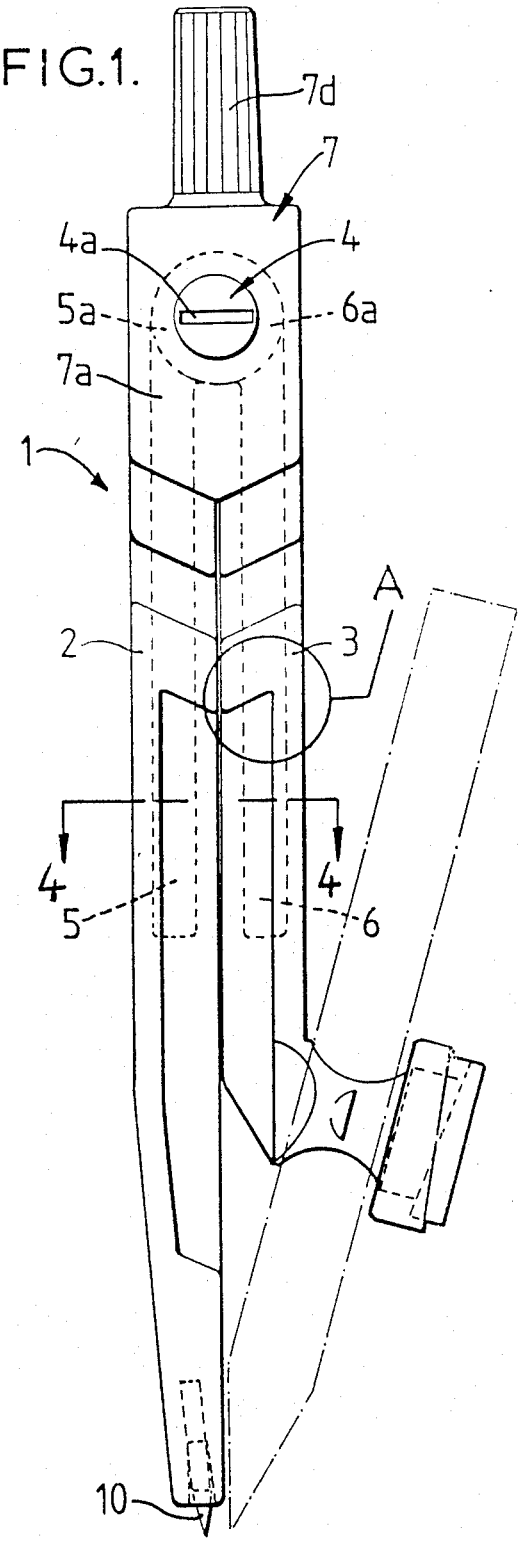
FIG. 1 shows a front view of the pair of compasses.
Figure 2:
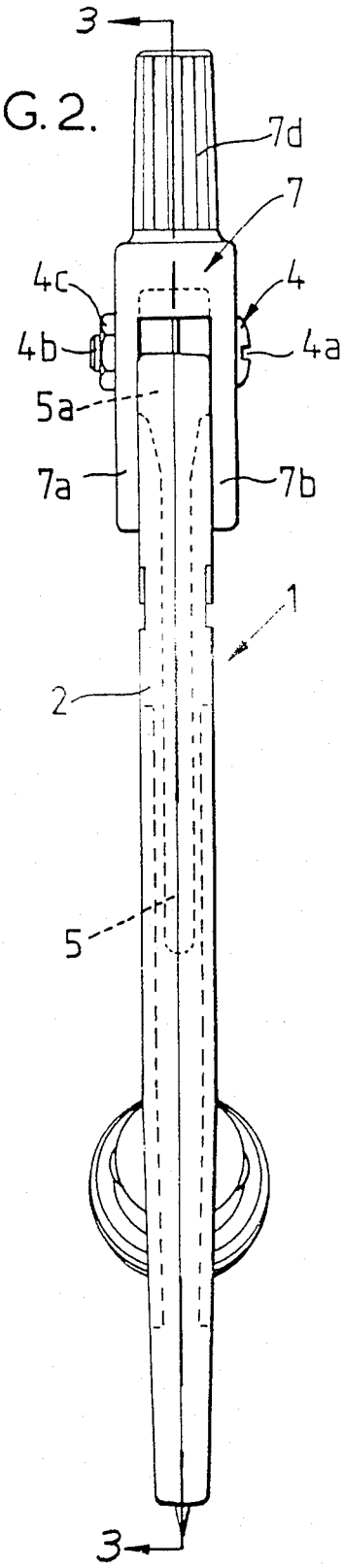
FIG. 2 shows a side view of the pair of compasses.
Figure 3:
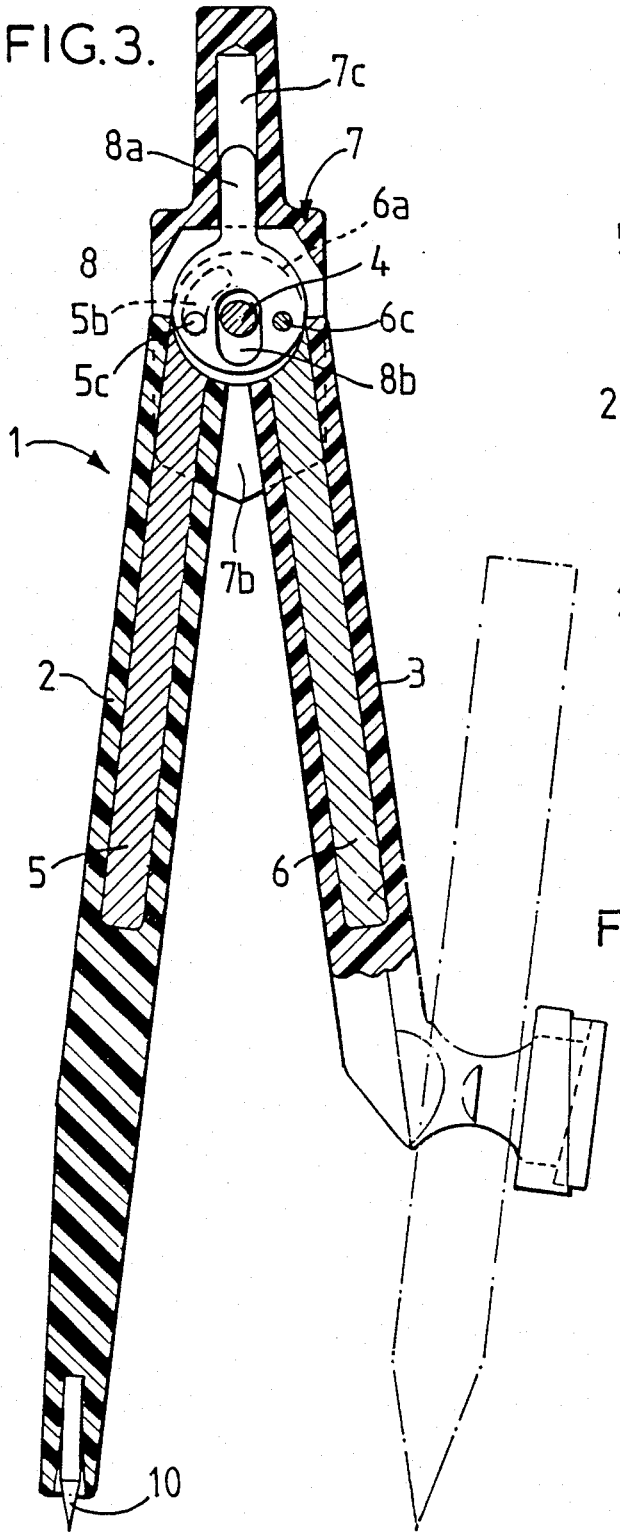
FIG. 3 shows a sectional front view of the pair of compasses taken on line II—II of FIG. 2.

Referring to FIGS. 1 to 4 of the drawings, a pair of compasses 1 is provided which is generally of a known type of construction employing a generally standard articulation of the legs 2, 3 together by means of a single pivot pin 4. However, the internal construction of the legs 2, 3 themselves is quite different and thus forms the subject of the present invention.

Each leg 2, 3 has a die cast metal insert 5, 6 extending along the length thereof (see FIG. 3 in particular) and each leg is formed in a book mould by injection moulding plastics material around the insert (a process termed "insert" moulding).

Figure 4:
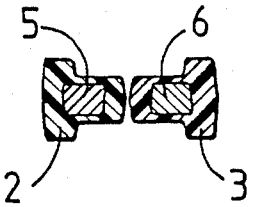
FIG. 4 shows a transverse sectional view through legs of the pair of compasses which is taken on line IV—IV of FIG. 1.

Each insert 5,6 is generally of rectangular cross section and extends centrally of the associated leg 2, 3. Insert 5 extends about half way along leg 2 from an upper end thereof whilst insert 6 extends substantially all the way along leg 3 from the upper end thereof. As shown in FIG. 4 the inserts 5,6 occupy about half the cross sectional area of the associated leg 2,3 and are of generally uniform thickness along the leg. The inserts 5,6 are identical and during the injection moulding of the legs circular part 5*a*,6*a* is left projecting from one end (the upper end) of the associated leg 2,3. Advantageously, the parts 5*a*,6*a* are, therefore, of a sufficiently strong and rigid material to be articulated together in a generally standard fashion just as if each leg had been formed entirely of a die cast metal. Additionally, the inserts 5,6 give the legs 2,3 a sufficiently strong and rigid characteristic necessary for precision drawing whilst being significantly cheaper to produce than a pair of compasses of a similar type employing legs entirely of die cast metal material.

The circular parts 5*a*,6*a* are of a generally known configuration having about half the thickness of the associated leg 2,3 (see FIG. 2) and such that they may be overlapped (superimposed) on one another, when received between the side walls 7*a* ,7*b* of a rigid nylon bow top 7 of the compasses 1, with the single pivot pin 4 passing through aligned circular apertures, in parts 5*a*,6*a*, of matching diameter to the pin 4. Pin 4 has a slotted head 4*a* (for a screwdriver) and a threaded end 4*b* received in a nut 4*b*. The pin 4 also passes through a flat, central, self centering metal plate 8 (of known configuration) having an elongate stem 8*a* extending into a cylindrical recess 7*c* in a knurled finger grip portion 7*d* of the bow top 7. Each part 5*a*,6*a* is formed with an internal arc-shaped recess 5*b*,6*b* (see FIG. 3) which receives a pin projection 6*c*,5*c* integral with the overlapping part 6*a*,5*a*. Each pin projection 5*c*,6*c* engages in a respective matching hole in the plate 8 whilst the pivot pin 4 passes through an elongate, oval opening 8*b* in the plate, thereby limiting the angular displacement of the legs 2,3 and "self centering" the legs relative to the bow top 7.

As shown the end of leg 3 is suitably configured to hold a writing implement (shown in chain dotted lines) but the precise configuration of the leg may be chosen to suit and indeed, the leg 3 may be similar or identical with leg 2 to provide a divider.

Leg 2 has a point 10 at one end thereof, which in this instance is not attached to the leg during the moulding process but is instead inserted therein afterwards in a manner known per se (interference fit), but nevertheless, the injection moulding process could be modified to incorporate the point into leg 2 during the moulding process if so desired. The legs 2, 3 have an external configuration (see FIG. 1) to facilitate extraction from the book mould and also to give strengthening characteristics.

The relative dimensions of the inserts 5*a*, 6*a* to the associated leg 2,3 as shown in the drawings are thought to be particularly advantageous and yet represent a significant saving in metal. It is believed that the present invention provides a very favourable manner of construction of a geometric instrument which can be of neat overall appearance and yet which takes advantage of the most suitable articulation technique for the legs.

Figure 5:
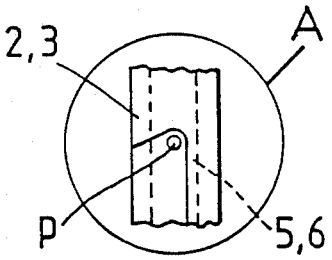
FIG. 5 shows a modification to the rigid detail A of FIG. 1 showing an insert certralising pip.
Figure 6:
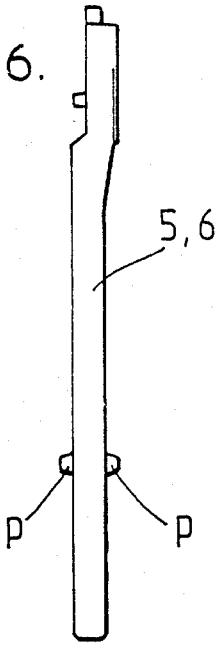
FIG. 6 shows a view of the insert modified in accordance with FIG. 5.

In order to improve the strength and rigidity of the compasses FIGS. 5 and 6 show a modification to the insert 5,6. In order to stabilise the insert 5,6 in the book mould to ensure there is no movement before or whilst the plastics material is injected, opposed, conical centralising pips p are provided which extend to the outer surfaces of the plastics material and to the inner surfaces of the mould. This ensures that the plastics flows evenly on all surfaces of the moulding:

The insert is also suitably shaped to provide the required degree of strength and rigidity. Nevertheless, although not shown in the drawings, in order to yield more strength in the region of the leg where it becomes solid plastics material the insert is, preferably, made somewhat longer (until insert 6 extends nearly to the end of leg 3). The insert is, thus, lengthened by about 1 cm. Additionally, and most importantly, the end of the insert is also tapered. Thus, a much greater strength is ensured at the termination of the insert in the leg.

The present invention may provide a cost effective method of obtaining strength and rigidity using basic low grade plastics rather than more expensive filled engineering materials. Said method may also provide a cost effective method of coating metal with plastics to give a variety of both colour and shape.

It is to be understood that the scope of the present invention is not to be unduly limited by the choice of particular terminology and use of any particular term herein may extend to use of any equivalent or generic term where sensible. Individual features of the geometric instrument, method of making some or functions relating thereto or particular combinations thereof may be individually patentably inventive and the geometric instrument may, for example, be any measuring or drawing instrument where an "insert" moulding technique could be of benefit.

What we claim is:

1. In a geometric instrument having a pair of elongated limbs articulatingly connected at their upper ends, the improvement wherein said limbs comprise an elongated moulded plastic lower leg portion and an elongated upper rigid metal leg portion embedded within and reinforcing said lower leg portion and having a rigid part projecting outwardly from the upper end of said lower leg portion free of said moulded plastic of said lower leg portion, said outwardly projecting parts being provided with cooperating overlapping members and means for rotatably interconnecting said overlapping members to permit articulation of same limbs, said metal upper leg portion is provided with laterally extending pips about which the mouldable plastic of said lower leg portion flows when said upper leg portion is embedded therein to prevent axial separation of said upper and lower leg portions and to act as centralizing means effective to stabilize said upper leg portion within the moulded plastic lower leg portion.

2. The instrument according to claim 1 wherein one of said limbs is provided at its lower end with a pin and the other one of said limb is provided with means for retaining a drawing instrument.

3. The instrument according to claim 1 wherein the pin and means for retaining a drawing instrument are integral formed with said lower leg portions of said limbs.

4. The instrument according to claim 1 in which said embedded parts of the upper portions of said linbs are between one third to one half the cross-sectional area of the associated limb.

5. The instrument according to claim 4 in which said embedded part of the upper portion of said limb is of uniform thickness and of rectangular cross-section extending centrally in the associated limb.

6. The instrument according to claim 1 wherein said means for rotatably interconnecting said limbs comprises a bow top and a pivot pin passing through aligned apertures in said overlapping members and through said bow top.

7. A geometric instrument comprising two legs articulated to one another and in which each of said two legs has a strengthening insert and in which said legs are articulated to one another with a single pivot pin, and in which each leg comprises a plastic portion moulded around a part of its associated insert, and in which the insert is of rigid die cast metal, and in which part of each insert projects free of said moulded plastic from one end of said leg and is used in the articulation of the two legs to one another by means of said pivot pin passing through aligned apertures in said projecting parts and through spaced side walls of a bow top which receives the projecting parts, and in which the articulation is self-centering, said instrument having centralizing means to stabilize the insert in the moulding process and the centralizing means comprises pips on the insert.

8. An instrument as claimed in claim 7 which is a compass having one leg which terminates in a hole and which is substantially shorter than the other of said legs, and the insert in the shorter leg extends almost the entire length of that leg, and an end of said insert in the shorter leg is tapered.

9. An instrument as claimed in claim 7 in which each insert is of about one third to one half the cross-sectional area of the associated leg, and each insert is of rectangular cross-section.

10. An instrument as claimed in claim 7 in which said projecting parts are rigid and free of moulded material.

* * * * *